US008535859B2

(12) United States Patent
Wu

(10) Patent No.: US 8,535,859 B2
(45) Date of Patent: Sep. 17, 2013

(54) PHOTOCONDUCTORS CONTAINING BIARYL POLYCARBONATE CHARGE TRANSPORT LAYERS

(75) Inventor: Jin Wu, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 245 days.

(21) Appl. No.: 12/942,144

(22) Filed: Nov. 9, 2010

(65) Prior Publication Data

US 2012/0115077 A1 May 10, 2012

(51) Int. Cl.
*G03G 5/04* (2006.01)

(52) U.S. Cl.
USPC ..... 430/58.35; 430/58.05

(58) Field of Classification Search
USPC ..... 430/58.35, 58.05
See application file for complete search history.

(56) References Cited

U.S. PATENT DOCUMENTS

| | | | | |
|---|---|---|---|---|
| 4,265,990 | A | 5/1981 | Stolka et al. | |
| 4,587,189 | A | 5/1986 | Hor et al. | |
| 4,654,284 | A | 3/1987 | Yu et al. | |
| 5,096,795 | A | 3/1992 | Yu | |
| 5,482,811 | A | 1/1996 | Keoshkerian et al. | |
| 5,521,306 | A | 5/1996 | Burt et al. | |
| 5,919,590 | A | 7/1999 | Yu et al. | |
| 5,935,748 | A | 8/1999 | Yu et al. | |
| 6,303,254 | B1 | 10/2001 | Yu et al. | |
| 6,528,226 | B1 | 3/2003 | Yu et al. | |
| 6,913,863 | B2 | 7/2005 | Wu et al. | |
| 6,919,419 | B2 * | 7/2005 | Ri et al. | 528/196 |
| 6,939,652 | B2 | 9/2005 | Yu | |
| 7,125,951 | B2 | 10/2006 | Boyles et al. | |
| 7,687,584 | B2 | 3/2010 | Boyles et al. | |
| 2009/0253056 | A1 * | 10/2009 | Yu | 430/58.05 |

OTHER PUBLICATIONS

Novel Polyethercarbonates: Synthesis and Polymeriztion of 1,3-bis(3-fluoro-4-hydroxyphenyl)benzene and 1,3-bis(4-hydroxyphenyl)benzene. David A. Boyles, Tsvetanka S. Filipova, Kevin Krischenmann, John T. Bendier, Polymer Preprints 2009, 50(2), 545, American Chemical Society, pp. 545-546.*

* cited by examiner

*Primary Examiner* — Mark F Huff
*Assistant Examiner* — Rachel Zhang
(74) *Attorney, Agent, or Firm* — Eugene O. Palazzo

(57) ABSTRACT

A photoconductor that includes a supporting substrate, an optional ground plane layer, an optional hole blocking layer, an optional adhesive layer, a photogenerating layer, and at least one charge transport layer, and where the charge transport layer contains a biaryl polycarbonate, or a mixture of a biaryl polycarbonate and a second polymer such as a polycarbonate.

11 Claims, 1 Drawing Sheet

PHOTOCONDUCTORS CONTAINING BIARYL POLYCARBONATE CHARGE TRANSPORT LAYERS

There is disclosed a photoconductor comprising an optional supporting substrate, a photogenerating layer and a charge transport layer, where the charge transport layer contains a biaryl polycarbonate, or a mixture of a biaryl polycarbonate and a second polymer such as a polycarbonate.

BACKGROUND

Photoconductors that are selected for imaging systems, such as xerographic imaging processes, are known. These photoconductors usually contain certain photogenerating layer pigments and charge transport layer components. A problem associated with a number of the known photoconductors is that their surface layers may have minimum resistance or lack a sufficient resistance to abrasion from dust, charging rolls, toner, and carrier that requires the untimely replacement of the photoconductors at significant costs. While used photoconductor components can be partially recycled, there continues to be added costs and potential environmental hazards when recycling. Further, the surface layers of photoconductors are subject to scratches that decrease their lifetime, and in xerographic imaging systems adversely affects the quality of the developed images. Another problem is that mixtures of components selected for the photogenerating and charge transport layers may not be compatible, or their compatibility needs improvement, for example where the charge transport materials are not sufficiently dispersible in the polymeric binders, or where the glass transition temperature of the polymeric binder is not sufficiently high enough, such as above 125° C. and up to 400° C. This may cause significant wear or abrasion of the polymeric binder.

Thus, there is a need for abrasion resistant photoconductors with enhanced mechanical characteristics, especially in xerographic systems where biased charging rolls are used. There is also a need for scratch resistant photoconductors with acceptable ghosting characteristics. Further, there is a need for new polymeric binders that can effectively have dispersed therein a charge transport compound, and which binders are compatible with polycarbonates typically used in photoconductors.

Additionally, there continues to be a need for polymeric photoconductor binders that possess a high glass transition temperature. Moreover, there remains a need for photoconductors with minimal wearing of the charge transport layer or layers, and the minimization or substantial elimination of undesirable ghosting on developed images, such as xerographic images, including decreased ghosting at various relative humidities.

Photoconductors with excellent cyclic characteristics and stable electrical properties, minimal charge deficient spots (CDS), and acceptable lateral charge migration (LCM) characteristics, such as excellent LCM resistance, are also desirable.

These and other needs are believed to be achievable in embodiments of the photoconductors disclosed herein.

FIGURE

There are provided the following figures to further illustrate the photoconductor disclosed herein.

SUMMARY

Disclosed is a photoconductor comprising a supporting substrate, a photogenerating layer, and a charge transport layer, and wherein the charge transport layer comprises a biaryl polycarbonate.

Also, disclosed is a photoconductor comprising in sequence a supporting substrate, a hole blocking layer, an adhesive layer, a photogenerating layer, and a charge transport layer, and wherein the charge transport layer contains a charge transport component present in an amount of from about 30 to about 50 weight percent; a biaryl polycarbonate present in an amount of from about 10 to about 30 weight percent, and a polycarbonate present in an amount of from about 30 to about 50 weight percent, and wherein the biaryl polycarbonate is selected from the group consisting of those represented by the following formulas/structures

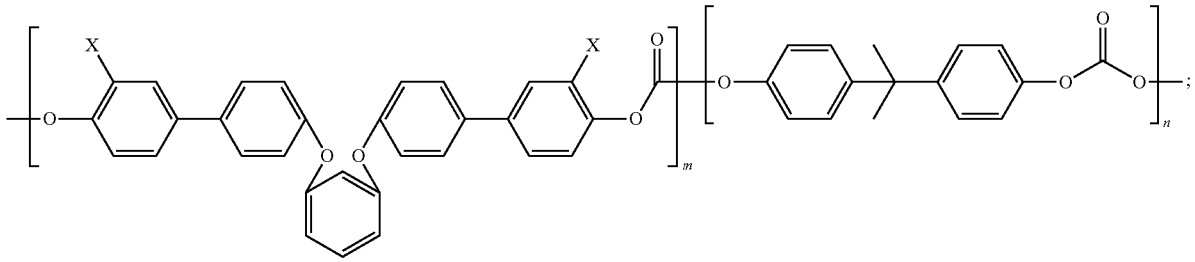

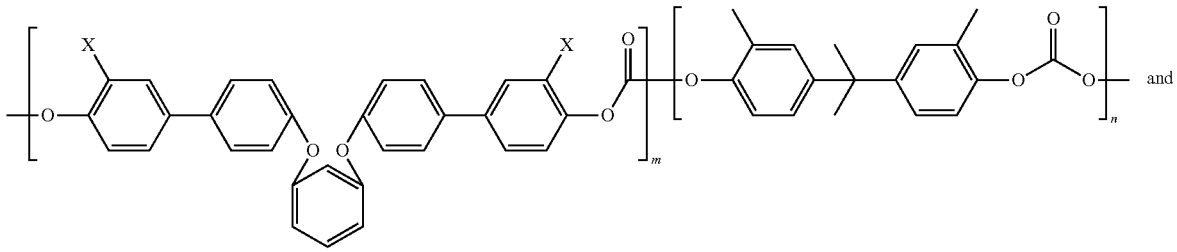

and

-continued

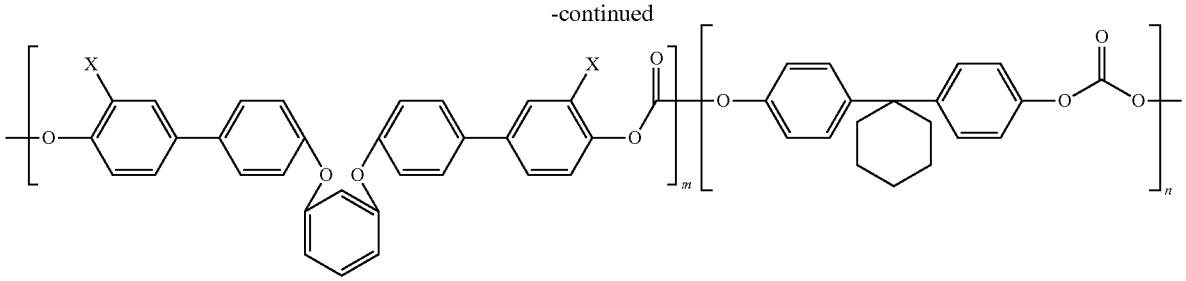

wherein X is hydrogen, or a halogen of fluorine, bromine, or chlorine; m is from about 5 to about 40 mole percent, and n is from about 95 to about 60 mole percent, and wherein the total of m and n is about 100 mole percent, and wherein the hole blocking layer comprises an aminosilane represented by

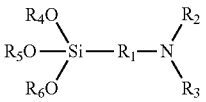

wherein $R_1$ is an alkylene; $R_2$ and $R_3$ are alkyl, hydrogen, or aryl, and each $R_4$, $R_5$ and $R_6$ is alkyl.

There is further disclosed a photoconductor comprising a supporting substrate, a hole blocking layer, an adhesive layer, a photogenerating layer, and a charge transport layer, and wherein the charge transport layer contains a charge transport component, a mixture of a biaryl polycarbonate and a polycarbonate, and wherein the biaryl polycarbonate is represented by the following formulas/structures

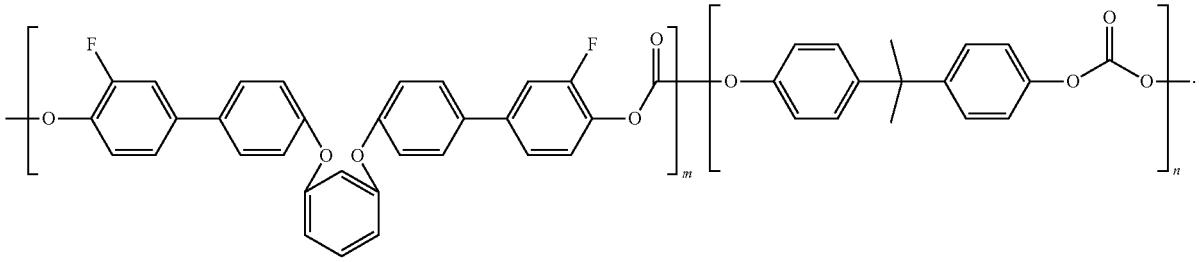

where m is from about 15 to about 25 mole percent, and n is from about 85 to about 75 mole percent and wherein the polycarbonate is selected from the group consisting of poly (4,4'-dihydroxy-diphenyl-1-1-cyclohexane), poly(4,4'-isopropylidene-diphenylene)carbonate, poly(4,4'-cyclohexylidine diphenylene)carbonate, and poly(4,4'-isopropylidene-3,3'-dimethyl-diphenyl)carbonate.

EMBODIMENTS

In aspects of the present disclosure, there is illustrated a photoconductor comprising an optional conductive supporting substrate, a photogenerating layer, and a charge transport layer, and wherein the charge transport layer contains hole transport molecules and a) a binder of a biaryl polycarbonate, or b) a mixture of a biaryl polycarbonate and a second polymer.

Figure 1:
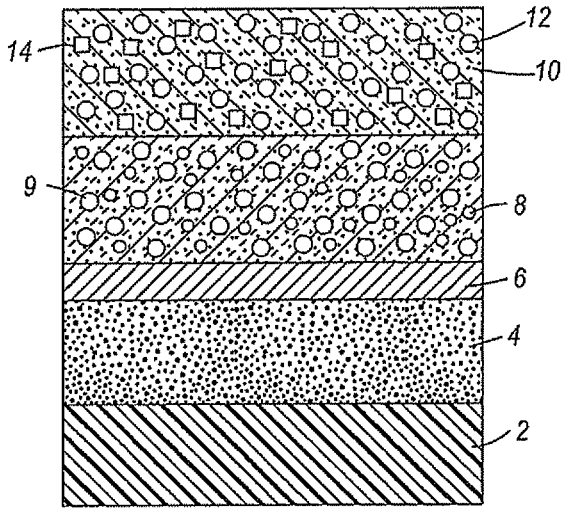
FIG. 1 illustrates an embodiment of a layered photoconductor of the present disclosure.

In FIG. 1 there is illustrated an exemplary photoconductor comprising a supporting substrate layer 2, a hole blocking layer 4, an adhesive layer 6, a photogenerating layer 8 comprising photogenerating pigments 9, and a charge transport layer 10 comprising charge transport components 12, and a) components of a biaryl polycarbonate, or b) a mixture of biaryl polycarbonates and second polymers 14.

Figure 2:
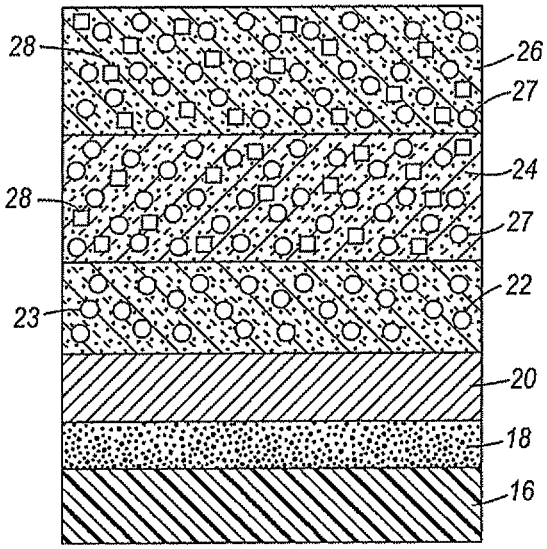
FIG. 2 illustrates another embodiment of a layered photoconductor of the present disclosure.

In FIG. 2 there is illustrated another embodiment of a photoconductor comprising a supporting substrate layer 16, a hole blocking layer 18, an adhesive layer 20, a photogenerating layer 22 comprising photogenerating pigments 23, a first charge transport layer 24 comprising charge transport components 27, and a) biaryl polycarbonates, or b) a mixture of a biaryl polycarbonates and second polymers 28, and a second charge transport layer 26 comprising charge transport components 27, and a) components of biaryl polycarbonates, or b) a mixture of a biaryl polycarbonates and second polymers 28.

Substrate

The substrate may comprise a layer of an electrically nonconductive or conductive material such as electrically nonconducting materials. Examples include polyesters, polycarbonates, polyamides, polyurethanes, and the like, and mixtures thereof.

An electrically conducting supporting substrate may be any suitable metal including aluminum, nickel, steel, copper, gold, and the like, and mixtures thereof, or a polymeric material filled with an electrically conducting substance. Examples of electrically conducting substances include carbon, metallic powder, and the like, or an organic electrically conducting material. The electrically insulating or conductive substrate may be in the form of an endless flexible belt, a web, a rigid cylinder, a sheet, a drelt (a cross between a drum and a belt), and the like.

In embodiments where the substrate layer is not conductive, the surface may be rendered electrically conductive by depositing thereon a known electrically conductive coating. The conductive coating may vary in thickness over substantially wide ranges, such as from about 1 to about 50 microns, or from about 3 to about 25 microns, depending upon the optical transparency, degree of flexibility desired, and economic factors.

The thickness of the photoconductor substrate layer depends on many factors, including economical considerations, electrical characteristics, adequate flexibility, availability, cost of the specific components for each layer, and the like, thus this layer may be of a substantial thickness, for example up to about 3,000 microns, such as from about 1,000 to about 2,000 microns, from about 500 to about 1,000 microns, or from about 300 to about 700 microns, or of a minimum thickness. In embodiments, the thickness of this layer is from about 75 to about 300 microns, or from about 100 to about 150 microns.

Illustrative examples of substrates include a layer of insulating material including inorganic or organic polymeric materials, such as MYLAR® (a commercially available polymer), MYLAR® containing titanium, a layer of an organic or inorganic material having a semiconductive surface layer, such as indium tin oxide or aluminum arranged thereon, or a conductive material inclusive of aluminum, chromium, nickel, brass, or the like, or mixtures thereof. The substrate may be flexible, seamless, or rigid, and may have a number of many different configurations, such as for example, a plate, a cylindrical drum, a scroll, an endless flexible belt, a drelt, and the like. In embodiments, the substrate is in the form of a seamless flexible belt.

Anticurl Layer

In some situations, it may be desirable to coat an anticurl layer on the back of the substrate, particularly when the substrate is a flexible organic polymeric material. This anticurl layer is sometimes referred to as an anticurl backing layer. Suitable materials for an anticurl layer include, for example, polycarbonate materials commercially available as MAKROLON®, and the like. The anticurl layer can be of a thickness of from about 0.1 to about 5 microns, from about 0.5 to about 3 microns, or from about 1 to about 2 microns.

Ground Plane Layer

Positioned on the top side of the substrate can be included a ground plane such as gold, gold containing compounds, aluminum, titanium, titanium/zirconium, and other suitable known components. The thickness of the ground plane layer is from about 10 to about 100 nanometers, from about 20 to about 50 nanometers, or about 35 nanometers. The titanium or titanium/zirconium ground plane has a thickness of from about 10 to about 30 nanometers, or about 20 nanometers.

Hole-Blocking Layer

A charge blocking layer or hole blocking layer may optionally be applied to the electrically conductive supporting substrate surface prior to the application of a photogenerating layer. An optional hole blocking layer, when present, is usually in contact with the ground plane layer, and also can be in contact with the supporting substrate. The hole blocking layer generally comprises any of a number of known components as illustrated herein, such as metal oxides, phenolic resins, aminosilanes, and the like, and mixtures thereof. The hole-blocking layer can have a thickness of from about 0.01 to about 30 microns, or from about 0.02 to about 5 microns, or from about 0.03 to about 0.5 microns.

Examples of aminosilanes that can be included in the hole blocking layer can be represented by

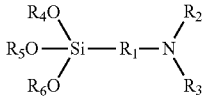

wherein $R_1$ is a straight chain or a branched alkylene group containing from 1 to about 25, from 1 to about 18, from 1 to about 12, or from 1 to about 6 carbon atoms; $R_2$ and $R_3$ are independently selected from the group consisting of at least one of hydrogen, alkyl containing from 1 to about 12 carbon atoms, or from 1 to about 4 carbon atoms; aryl with from about from 6 to about 24, from 6 to about 18, or from 6 to about 12 carbon atoms, such as a phenyl group; and a poly (alkylene amino) group such as a poly(ethylene amino) group; and where $R_4$, $R_5$ and $R_6$ are independently an alkyl group containing from 1 to about 10 carbon atoms, or from 1 to about 4 carbon atoms.

Specific examples of suitable aminosilanes include 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilyipropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy) silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl2-(3-trimethoxysilylpropylamino)ethylamino-3-proprionate, (N,N'-dimethyl 3-amino)propyl triethoxysilane, N,N-dimethylaminophenyl triethoxysilane, trimethoxysilyl propyidiethylene triamine, and the like, and mixtures thereof. Yet more specific aminosilane materials are 3-aminopropyl triethoxysilane (γ-APS), N-aminoethyl-3-aminopropyl trimethoxysilane, (N,N-dimethyl-3-amino)propyl triethoxysilane, and mixtures thereof.

The aminosilane may be hydrolyzed to form a hydrolyzed silane solution before being added into the final hole blocking layer coating solution or dispersion. During hydrolysis of the aminosilanes, the hydrolyzable groups, such as the alkoxy groups, are replaced with hydroxyl groups. The pH of the hydrolyzed silane solution can be controlled to obtain excellent characteristics on curing, and to result in electrical stability. A solution pH of, for example, from about 4 to about 10 can be selected, such as a pH of from about 7 to about 8. Control of the pH of the hydrolyzed silane solution may be affected with any suitable material, such as generally organic acids or inorganic acids. Typical organic and inorganic acids include acetic acid, citric acid, formic acid, hydrogen iodide, phosphoric acid, hydrofluorosilicic acid, p-toluene sulfonic acid, and the like.

The hole blocking layer can, in embodiments, be prepared by a number of known methods, the process parameters being dependent, for example, on the photoconductor member desired. The hole blocking layer can be coated as a solution or a dispersion onto the supporting substrate or on to the ground plane layer by the use of a spray caster, dip coater, extrusion coater, roller coater, wire-bar coater, slot coater, doctor blade coater, gravure coater, and the like, and dried at from about 40° C. to about 200° C., or from 75° C. to 150° C. for a suitable period of time, such as from about 1 minute to about 10 hours, from about 40 minutes to about 100 minutes, or from about 1 hour to about 4 hours in the presence of an air flow. The coating can be accomplished in a manner to provide a final hole blocking layer coating thickness of, for example, from about 0.01 to about 30 microns, from about 0.02 to about 5 microns, or from about 0.03 to about 0.5 micron after drying.

Adhesive Layer

An adhesive layer may be included between the hole blocking layer and the photogenerating layer. Typical adhesive layer materials include polyesters, polyurethanes, copolyesters, polyamides, polyvinyl butyrals), polyvinyl alcohols), and polyacrylonitriles, and the like. The adhesive layer thickness can be from about 0.001 to about 1 micron, from about 0.1 to about 0.5 micron or from about 0.05 to about 0.3 micron. Optionally, this layer may contain effective suitable amounts of from about 1 to about 10 weight percent of conductive and nonconductive particles, such as zinc oxide, titanium dioxide, silicon nitride, carbon black, and the like, and mixtures thereof.

Photogenerating Layer

Usually, the photogenerating layer is applied onto the supporting substrate and a charge transport layer, or plurality of charge transport layers is formed on the photogenerating layer. The charge transport layer may be situated on the photogenerating layer, the photogenerating layer may be situated on the charge transport layer, or when more than one charge transport layer is present they can be contained on the photogenerating layer.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes such as bis(benzimidazo) perylene, titanyl phthalocyanines, and the like. More specifically, examples include vanadyl phthalocyanines, Type V hydroxygallium phthalocyanines, high sensitivity titanyl phthalocyanines, and inorganic components, such as selenium, selenium alloys, and trigonal selenium, pigments of crystalline selenium, and its alloys; and Groups H to VI compounds. Organic pigment examples are quinacridones, polycyclic pigments, such as dibromo anthanthrone pigments, perinone diamines, polynuclear aromatic quinones, and azo pigments, including bis-, tris- and tetrakis-azos, and the like.

The photogenerating pigment can be dispersed in a resin binder similar to the resin binders selected for the charge transport layer, or alternatively, no resin binder need be present. For example, the photogenerating pigment is present in an optional resinous binder composition in various amounts inclusive of up to 100 percent by weight. Generally, from about 5 to about 95 percent by volume of the photogenerating pigment is dispersed in about 95 to about 5 percent by volume of a resinous binder, or from about 20 to about 30 percent by volume of the photogenerating pigment is dispersed in about 70 to about 80 percent by volume of the resinous binder composition. In one embodiment, about 90 percent by volume of the photogenerating pigment is dispersed in about 10 percent by volume of the resinous binder composition, and which resin may be selected from a number of known polymers as illustrated herein, such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like.

It is often desirable to select a coating solvent for the photogenerating layer mixture, and which solvent does not substantially disturb or adversely affect the previously coated layers of the photoconductor. Examples of coating solvents used for the photogenerating layer coating mixture are, for example, ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

Examples of polymeric binder materials that can be selected as the matrix for the photogenerating layer include thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

The photogenerating layer can be of a thickness of from about 0.05 to about 10 microns, 0.01 to 10 microns, or from about 0.25 to about 2 microns when the photogenerating compositions are present in an amount of from about 30 to about 75 percent by volume.

Charge Transport Layer

The disclosed photoconductor also comprises at least one charge transport layer, wherein the charge transport layer generally comprises a charge transport component, a biaryl polycarbonate, and optionally one or more additional polymers. At least one charge transport layer is 1, 2, 3, or 4 layers.

Examples of biaryl polycarbonates included in the charge transport layer, or at least one charge transport layer in an amount, for example, of from about 40 to about 80, or from about 50 to about 70 weight percent can be selected from the group consisting of those represented by the following formulas/structures

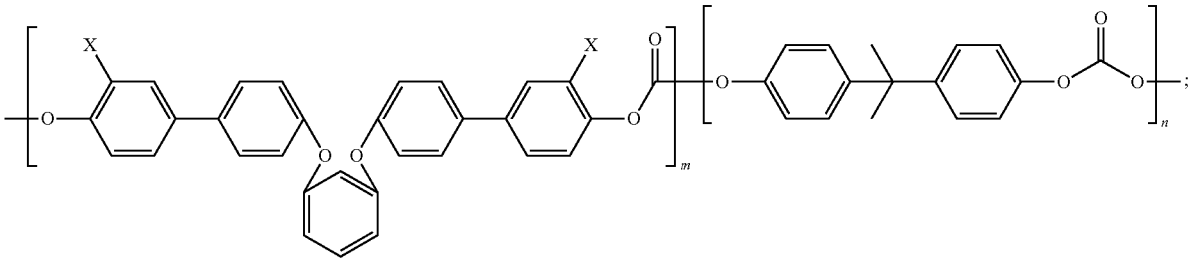

-continued

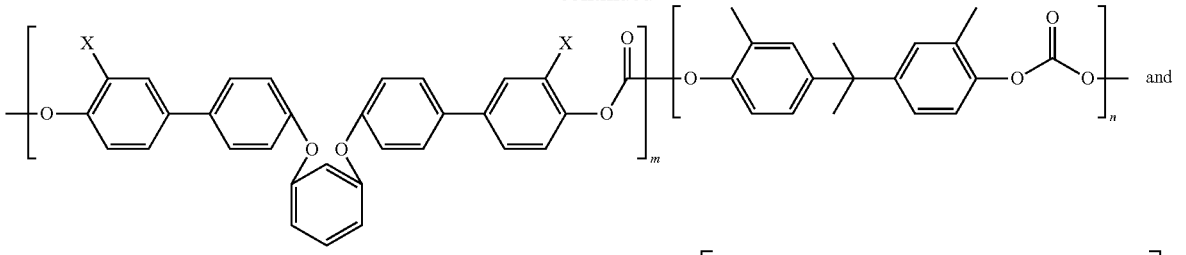

and

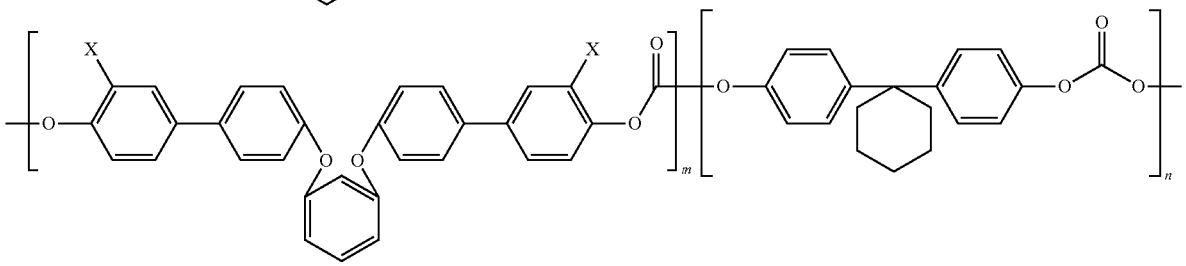

wherein X is a halogen, such as fluorine, chlorine, bromine, iodine, or mixtures thereof, or a hydrogen atom; m and n represent mole percents, and where the sum of m and n thereof is about 100 mole percent. The mole percent for m can be from about 1 to about 40 mole percent, from about 10 to about 30 mole percent, or from about 15 to about 25 mole percent. Examples of the mole percent for n are from about 99 to about 60 mole percent, from about 95 to about 70 mole percent, from about 95 to about 80 mole percent, or from about 80 to about 98 mole percent. In one embodiment, m is about 20 mole percent and n is about 80 mole percent. The mole percent values illustrated herein were determined by NMR analysis. One such suitable biaryl polycarbonate copolymer is available from, for example, South Dakota School of Mines and Technology, and this one and others can be prepared as illustrated in U.S. Pat. Nos. 7,125,951 and 7,687,584, the disclosures of which are totally incorporated herein by reference.

The biaryl polycarbonate copolymers have a weight average molecular weight ($M_w$) of from about 10,000 to about 200,000, from about 20,000 to about 100,000, or from about 100,000 to about 195,000, and a number average molecular weight ($M_n$) of from about 5,000 to about 150,000, from about 5,000 to about 80,000, or from about 10,000 to about 60,000 as determined by known analytic processes, such as by GPC analysis.

Specific examples of biaryl polycarbonates selected for the charge transport layer are selected from the group consisting of those represented by the following formulas/structures

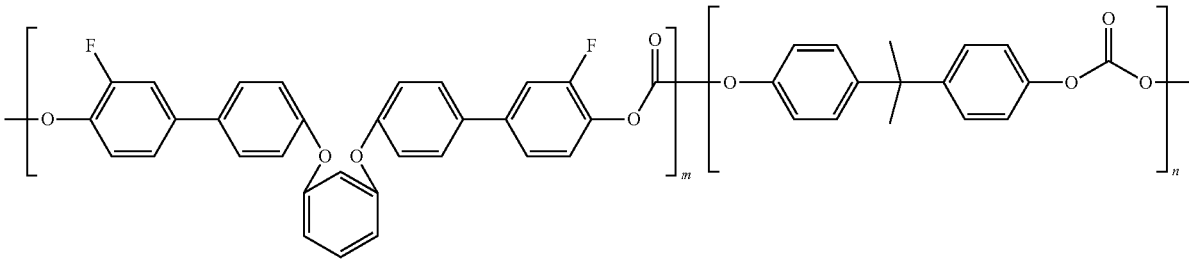

wherein m and n are as illustrated herein, such as where m is about 20 mole percent, and n is about 80 mole percent where the weight average molecular weight is from about 20,000 to about 40,000, and the number average molecular weight is from about 8,000 to about 14,000, wherein the molecular weights were determined by GPC analysis;

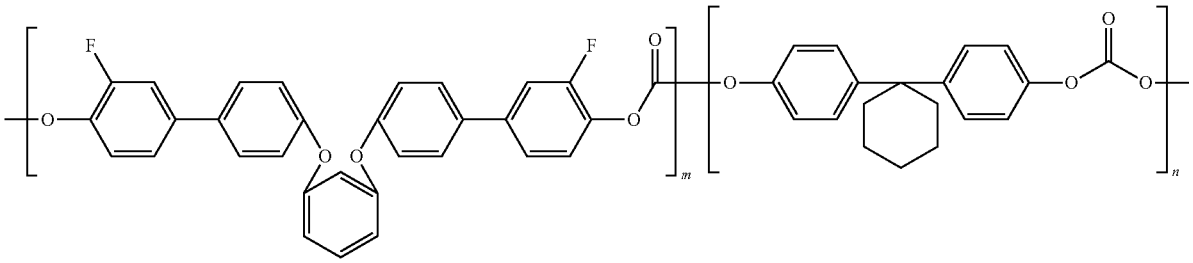

wherein m is about 30 mole percent, and n is about 70 mole percent;
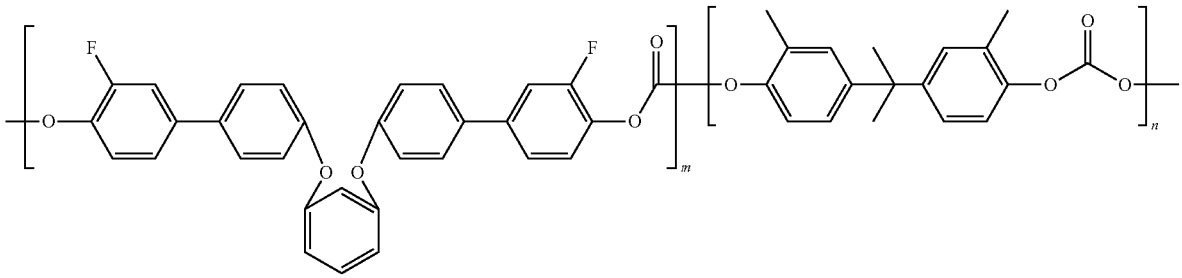
wherein m is about 35 mole percent, and n is about 65 mole percent;
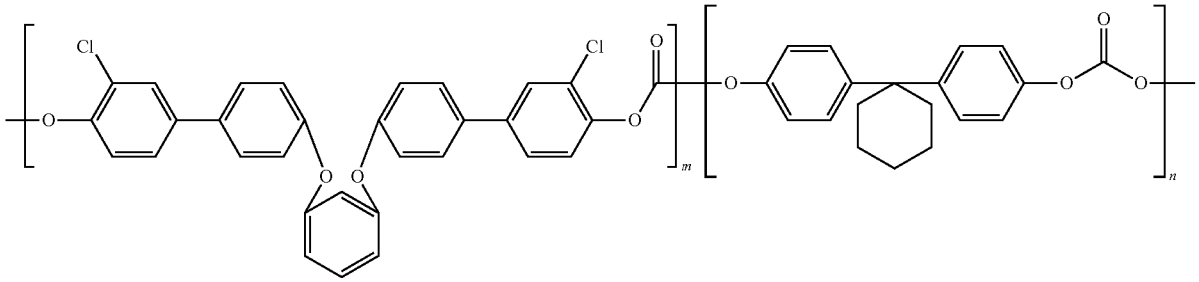
wherein m is about 25 mole percent, and n is about 75 mole percent;
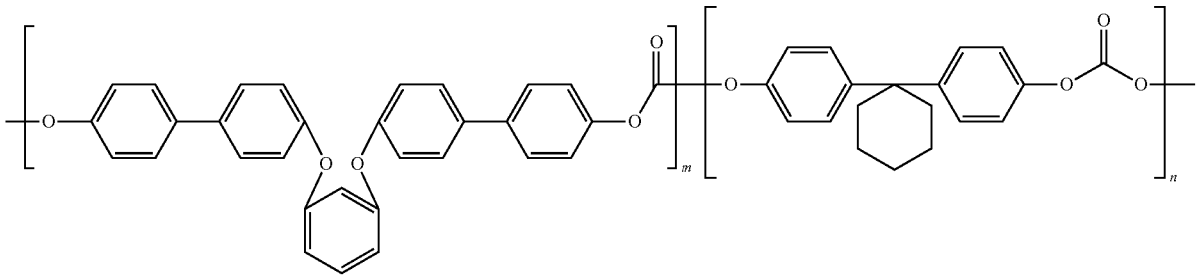
wherein m is about 15 mole percent, and n is about 85 mole percent;
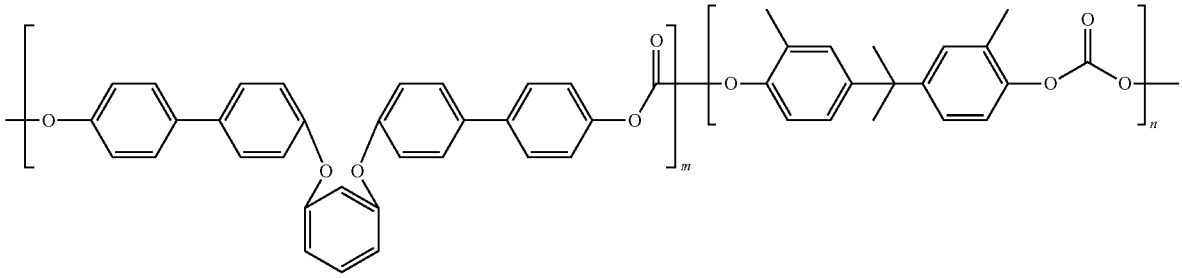

wherein m is about 20 mole percent, and n is about 80 mole percent; and

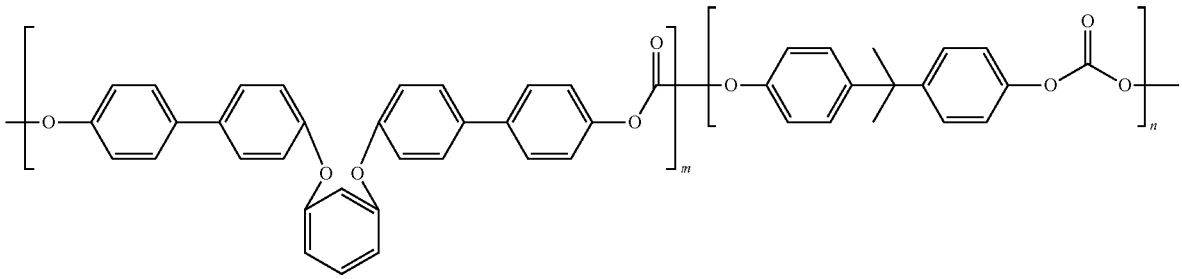

wherein m is about 10 mole percent, and n is about 90 mole percent. Mixtures of two or more biaryl polycarbonates can also be used.

Where a polycarbonate is selected as an additional polymer binder for the photoconductor charge transport layer or charge transport layers, the polycarbonate can be prepared from di(hydroxyphenyl)alkanes, such as 2,2-di(4-hydroxyphenyl)propane, as illustrated in U.S. Pat. No. 5,030,707, the disclosure of which is totally incorporated herein by reference. Specific examples of polycarbonates selected as the additional binder for the charge transport layer or charge transport layers, and present in amounts of from about 20 to about 65 weight percent, from about 35 to about 55 weight percent, or from about 30 to about 50 weight percent include PCZ-400 [poly(4,4'-dihydroxy-diphenyl-1-1-cyclohexane, $M_w$=40,000)] available from Mitsubishi Gas Chemical Company, Ltd.; poly(4,4'-isopropylidene-diphenylene)carbonate (also referred to as bisphenol-A-polycarbonate), poly(4,4'-cyclohexylidine diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like, and mixtures thereof, and other known suitable polycarbonates. The polycarbonates can have a number average molecular weight ($M_n$) of from about 10,000 to about 80,000, from about 30,000 to about 50,000, or from about 20,000 to about 60,000, and a weight average molecular weight ($M_w$) of from about 20,000 to about 100,000, or from about 40,000 to about 80,000, where $M_w$ and $M_n$ are determined by Gel Permeation Chromatography (GPC).

When a mixture of the biaryl polycarbonate copolymer and a second polymer binder is selected, such as the polycarbonates disclosed herein, the amount of the biaryl polycarbonate present in the charge transport layer can be from about 1 to about 99 weight percent, from about 10 to about 80 weight percent, or from about 30 to about 50 weight percent, and the amount of the second polymer can be, for example, from about 99 to about 1 weight percent, from about 90 to about 20 weight percent, or from about 70 to about 50 weight percent, and where the total of the biaryl polycarbonate and the second polymer is about 100 weight percent.

Examples of charge transport components included in the charge transport layer are selected from the group consisting of those represented by the following formulas/structures

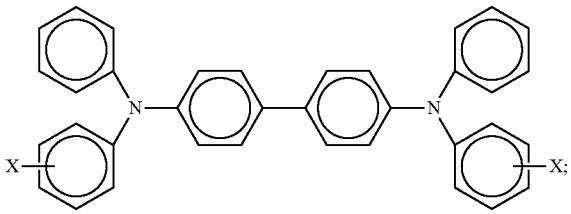

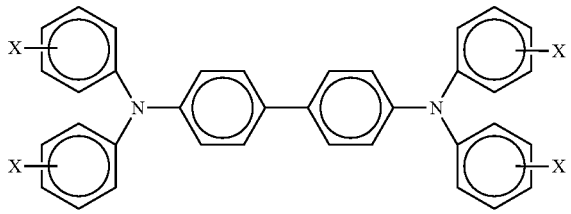

wherein X is alkyl, such as $CH_3$; alkoxy; aryl; and derivatives thereof; a halogen, such as Cl; or mixtures thereof; and molecules of the following formulas

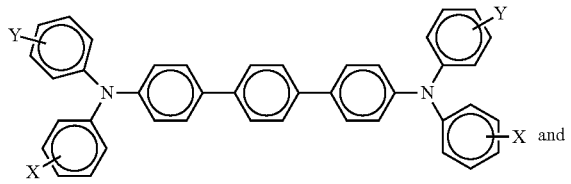

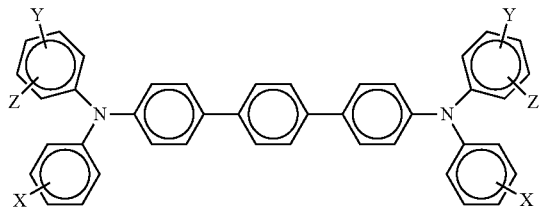

wherein X, Y and Z are independently alkyl, alkoxy, aryl, a halogen, or mixtures thereof.

The alkyl and alkoxy groups for the above charge transport compounds contain from 1 to about 25 carbon atoms, such as from 1 to about 12 carbon atoms, such as methyl, ethyl, propyl, butyl, pentyl, and the corresponding alkoxides. Aryl can contain from about 6 to about 36 carbon atoms, from about 6 to about 24, from about 6 to about 18, from about 6 to about 12 carbon atoms, such as phenyl, napthyl, and anthryl, and the like. Halogen includes chloride or chlorine, bromide or bromine, iodide or iodine, and fluoride or fluorine.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules that can be selected are described in U.S. Pat. Nos. 4,921,773 and 4,464,450, the disclosures of which are totally incorporated herein by reference.

A small molecule charge transporting compound that permits injection of holes into the photogenerating layer with high efficiency, and transports them across the charge transport layer with short transit times includes N,N'r-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. When desired, the charge transport material in the charge transport layer may comprise a polymeric charge transport material, or a combination of a small molecule charge transport material and a polymeric charge transport material.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The charge transport layer can be from about 5 to about 75 microns, or from about 10 to about 40 microns in thickness.

Examples of components or materials optionally incorporated into the charge transport layers, or at least one charge transport layer to enable excellent lateral charge migration (LCM) resistance include hindered phenolic antioxidants, such as tetrakis methylene(3,5-di-tert-butyl-4-hydroxy hydrocinnamate)methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20 weight percent, from about 1 to about 10 weight percent, or from about 3 to about 8 weight percent.

Also included within the scope of the present disclosure are methods of imaging and printing with the photoconductors illustrated herein. These methods generally involve the formation of an electrostatic latent image on the imaging member, followed by developing the image with a toner composition comprised, for example, of thermoplastic resin, colorant, such as pigment, charge additive, and surface additive subsequently transferring the toner image to a suitable image receiving substrate, and permanently affixing the image thereto. In those environments wherein the photoconductor is to be used in a printing mode, the imaging method involves the same operation with the exception that exposure can be accomplished with a laser device or image bar. More specifically, the flexible photoconductors disclosed herein can be selected for the Xerox Corporation iGEN® machines that generate with some versions over 100 copies per minute. Processes of imaging, especially xerographic imaging and printing, including digital and/or color printing are thus encompassed by the present disclosure. The imaging members are, in embodiments, sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying and printing processes inclusive of digital xerographic processes.

The following Examples are being submitted to illustrate embodiments of the present disclosure.

COMPARATIVE EXAMPLE 1

On a 30 millimeter thick aluminum drum substrate there was deposited an undercoat or hole blocking layer as follows:

Zirconium acetylacetonate tributoxide (35.5 parts), γ-aminopropyl triethoxysilane (4.8 parts), and polyvinyl butyral) BM-S (2.5 parts) were dissolved in n-butanol (52.2 parts). The resulting solution was then coated by a dip coater on the above aluminum drum substrate, followed by heating the solution at 59° C. for 13 minutes, humidified at 58° C. (dew point=54° C.) for 17 minutes, and drying at 135° C. for 8 minutes. The thickness of the resulting undercoat layer was approximately 1.3 microns. The solution heating can also be accomplished prior to coating it on the aluminum drum substrate.

A photogenerating layer, 0.2 micron in thickness, comprising chlorogallium phthalocyanine (Type C) was deposited on the above undercoat layer. The photogenerating layer coating dispersion was prepared as follows. 2.7 Grams of chlorogallium phthalocyanine (ClGaPc) Type C pigment were mixed with 2.3 grams of the polymeric binder (carboxyl-modified vinyl copolymer, VMCH, available from Dow Chemical Company), 15 grams of n-butyl acetate, and 30 grams of xylene. The resulting mixture was mixed in an Attritor mill with about 200 grams of 1 millimeter Hi-Bea borosilicate glass beads for about 3 hours. The dispersion mixture obtained was then filtered through a 20 micron Nylon cloth filter, and the solids content of the dispersion was diluted to about 6 weight percent.

Subsequently, a 29 micron charge transport layer was coated on top of the above photogenerating layer from a solution prepared by dissolving N,N'-diphenyl-N,N-bis(3-methylphenyl)-1,1'-biphenyl-4,4'-diamine (mTBD, 4 grams), and a film forming polymer binder PCZ-400 [poly(4,4'-dihydroxy-diphenyl-1-1-cyclohexane, $M_w$=40,000)] available from Mitsubishi Gas Chemical Company, Ltd. (6 grams) in a solvent mixture of 21 grams of tetrahydrofuran (THF), and 9 grams of toluene (70/30) followed by drying in an oven at about 120° C. for about 40 minutes. The resulting charge transport layer PCZ-400/mTBD ratio was 60/40.

EXAMPLE I

A photoconductor was prepared by substantially repeating the process of Comparative Example 1 in that the 29 micron thick charge transport layer was coated on top of the photogenerating layer from a solution prepared from (mTBD) N,N'-diphenyl-N,N-bis(3-methylphenyl)-1,1-biphenyl-4,4'-diamine (4 grams), the film forming polymer binder PCZ-400 poly(4,4'-dihydroxy-diphenyl-1-1-cyclohexane, $M_w$=40,000)), available from Mitsubishi Gas Chemical Company, Ltd. (4 grams), and 2 grams of the biaryl polycarbonate copolymer as represented by the following formula/structure where m is 20 mole percent, and n is 80 mole percent, and with a weight average molecular weight of 20,000, and a number average molecular weight of 8,000, and where the ratio of PCZ-400/biaryl polycarbonate/mTBD was 40/20/40.

EXAMPLE II

A photoconductor was prepared by substantially repeating the process of Comparative Example 1 with no polycarbonate, in that the 29 micron thick charge transport layer was coated on top of the photogenerating layer from a solution prepared from N,N'-diphenyl-N,N-bis(3-methylphenyl)-1,1'-biphenyl-4,4'-diamine (4 grams), and 6 grams of the biaryl polycarbonate copolymer of Comparative Example 1.

EXAMPLE III

Photoconductors are prepared by substantially repeating the process of Example I in that a 32 micron thick charge transport layer is coated on top of the photogenerating layer from a solution prepared with N,N'-diphenyl-N,N-bis(3-methylphenyl)-1,1'-biphenyl-4,4'-diamine (4 grams), the polycarbonate binder of poly(4,4'-isopropylidene-diphenylene) carbonate, poly(4,4'-cyclohexylidine diphenylene) carbonate, or poly(4,4'-isopropylidene-3,3'-dimethyl-diphenyl)carbonate (4 grams), and 2 grams of the biaryl polycarbonate copolymer of Comparative Example 1.

EXAMPLE IV

Photoconductors are prepared by substantially repeating the process of Example II in that a 29 micron thick charge transport layer is coated on top of the photogenerating layer from a solution prepared from N,N'-diphenyl-N,N-bis(3-methylphenyl)-1,1'-biphenyl-4,4'-diamine (4 grams), and 6 grams of the biaryl polycarbonate represented by one of the following structures/formulas

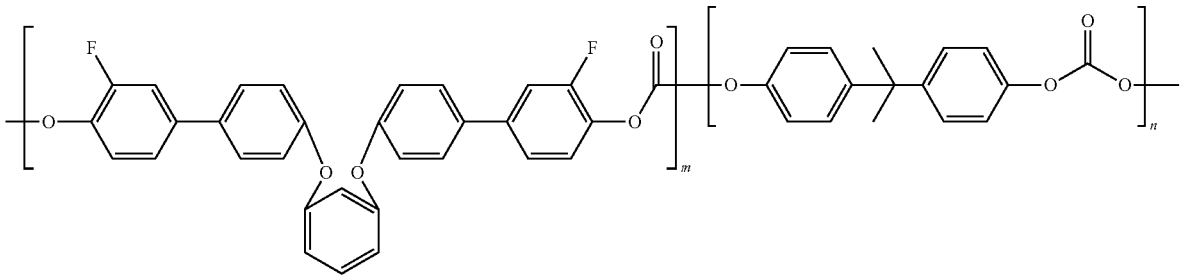

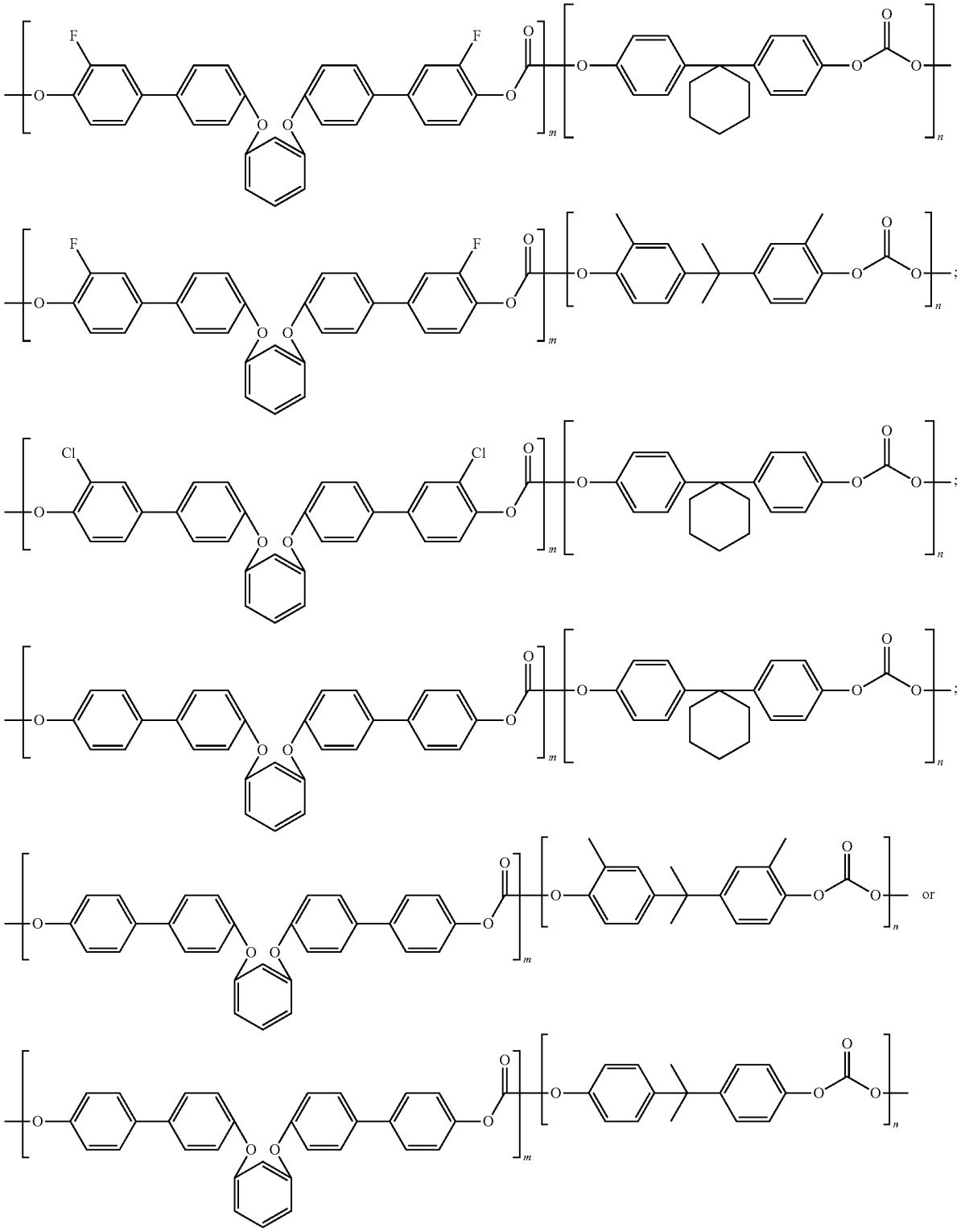

where m is 20 mole percent and n is 80 mole percent.

ELECTRICAL PROPERTY TESTING

The above prepared photoconductors of Comparative Example 1, and Examples I and II were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic (PIDC) curves from which the photosensitivity, and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The above photoconductors were tested at surface potentials of 700 volts with the exposure light intensity incrementally increased by means of regulating a series of neutral density filters; and the exposure light source was a 780 nanometer light emitting diode. The xerographic simulation was completed in an environmentally controlled light tight chamber at ambient conditions (40 percent relative humidity and 22° C.).

Substantially similar PIDCs were obtained for the above three photoconductors.

WEAR TESTING

Wear tests of the photoconductors of Comparative Example 1 and Example I were performed using a wear test fixture (biased charging roll, and peak to peak voltage of 1.45 kilovolts). The total thickness of each photoconductor was measured by a Permascope before each wear test was initiated. Then the photoconductors were separately placed into the wear fixture for 50 kilocycles. The total photoconductor thickness was measured again with the Permascope, and the difference in thickness was used to calculate wear rate (nanometers/kilocycle) of the photoconductors. The smaller the wear rate value, the more wear resistant was the photoconductor. The wear test data is summarized in Table 1.

TABLE 1

| | Wear Rate (Nanometers/Kilocycle) |
|---|---|
| Comparative Example 1 | 58 |
| Example I | 30.4 |

The Example I charge transport wear rate of about 30.4 nm/kcycle was about half of that of the Comparative Example 1 charge transport layer (about 58 nm/kcycle). The 30.4 nm/kcycle wear rate will extend the Example photoconductor life by about 100 percent.

Generally, the photoconductors illustrated herein have minimal wear characteristics of from about 25 to about 35 nanometers per kilocycle.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor consisting of a supporting substrate, a photogenerating layer, and a charge transport layer, and wherein said charge transport layer consists of a biaryl polycarbonate copolymer as represented by the following formula/structure wherein m and n represent mole percent, where the sum of m and n is 100 mole percent and wherein m is 20 mole percent and n 80 mole percent

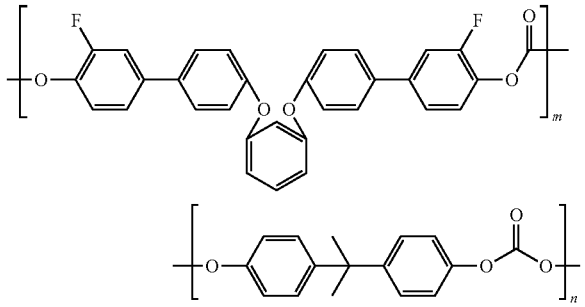

and an optional second polymer, and wherein said photoconductor has minimal wear characteristics of from about 25 to about 35 nanometers per kilocycle,

2. A photoconductor in accordance with claim 1 wherein said minimal wear characteristics is 30.4 nanometers per kilocycle.

3. A photoconductor in accordance with claim 1 wherein said biaryl polycarbonate has a weight average molecular weight of from about 10,000 to about 200,000, and a number average molecular weight of from about 5,000 to about 150,000.

4. A photoconductor in accordance with claim 1 wherein said second polymer is present.

5. A photoconductor in accordance with claim 4 wherein said second polymer is a polycarbonate.

6. A photoconductor in accordance with claim 5 wherein said polycarbonate is selected from the group consisting of poly(4,4'-dihydroxy-diphenyl-1-1-cyclohexane), poly(4,4'-isopropylidene-diphenylene) carbonate, poly(4,4'-cyclohexylidine diphenylene) carbonate, and poly(4,4'-isopropylidene-3,3'-dimethyl-diphenyl) carbonate.

7. A photoconductor in accordance with claim 1 wherein said charge transport layer consists of a first charge transport layer in contact with said photogenerating layer, and a second charge transport layer in contact with said first charge transport layer, and wherein said biaryl polycarbonate is present in said second charge transport layer.

8. A photoconductor in accordance with claim 1 wherein said charge transport layer consists of said biaryl polycarbonate, and a component selected tram the group consisting of

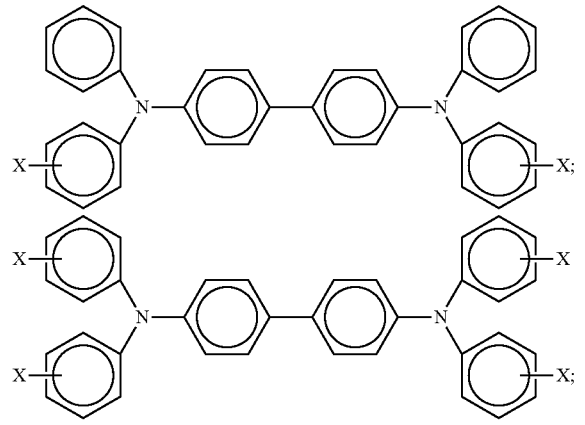

-continued

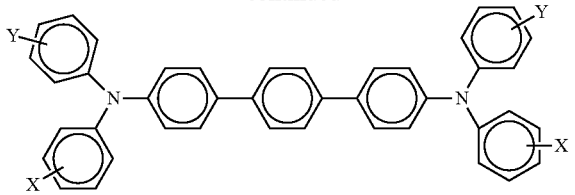

and

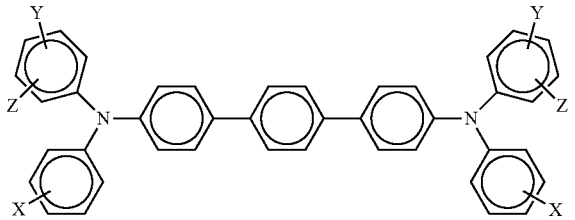

wherein X, Y, and Z are selected from the group consisting of alkyl, alkoxy, aryl, halogen, end mixtures thereof, and wherein said photogenerating layer consists of a photogenerating pigment selected from at least one of the group consisting of a titanyl phthalocyanine, a hydroxygallium phthalocyanine, a halogallium phthalocyanine, a chlorogallium phthalocyanine, and mixtures thereof.

9. A photoconductor in accordance with claim 1 wherein said charge transport layer includes a component selected from the group consting of N,N'-bis(methylphenyl)-1,1-biphenyl-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine.

10. A photoconductor consisting of and in sequence a supporting substrate, a hoe blocking layer, an adhesive layer, a photogenerating layer, and a charge transport layer, and wherein said charge transport layer contains a charge transport component present in an amount of from about 30 to about 50 weight percent; a biaryl polycarbonate copolymer present in an amount of from about 10 to about 30 weight percent, and a polycarbonate present in an amount of from about 30 to about 50 weight percent, and wherein said biaryl polycarbonate copolymer is represented by the following formula/structure wherein m and n represent mole percent, where the sum of m and n is 100 mole percent and wherein m is 20 mole percent and n 80 mole percent.

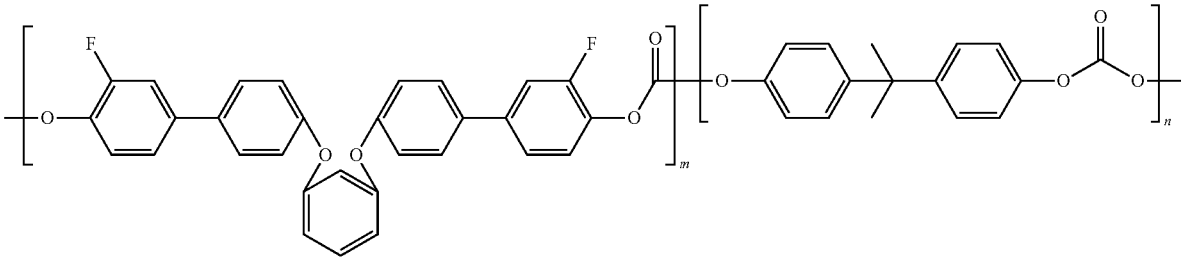

and wherein said hole blocking layer consists of an aminosilane represented by

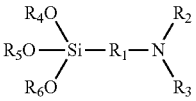

wherein $R_1$ is an alkylene; $R_2$ and $R_3$ are alkyl, hydrogen, or aryl, and each $R_4$, $R_5$ and $R_6$ is alkyl and wherein said photoconductor has minimal wear characteristics of from about 25 to about 35 nanometers per kilocycle.

11. A photoconductor consisting of a supporting substrate, a hole blocking layer, an adhesive layer, a photogenerating layer, and a charge transport layer, and wherein said charge transport layer contains a charge transport component, a mixture of a biaryl polycarbonate copolymer and a polycarbonate, and wherein said biaryl polycarbonate copolymer is represented by the following formula/structure

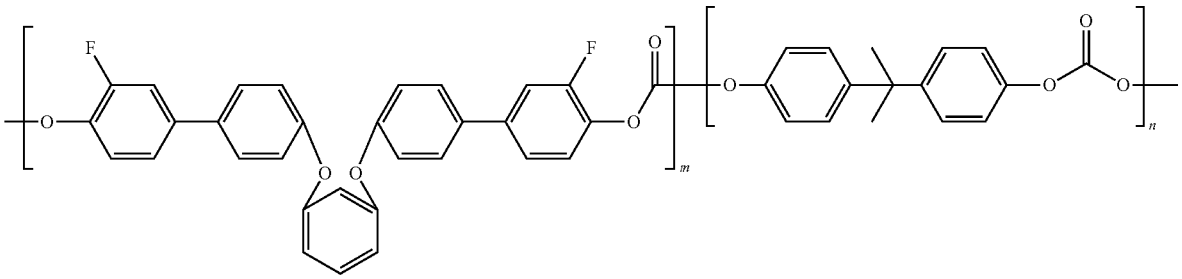

wherein m is about 20 mole percent and n is about 80 mole percent, and wherein said polycarbonate is selected from the group consisting of poly(4,4'-dihydroxy-diphenyl-1-1-cyclohexane), poly(4,4'-isopropyiidene-diphenyiene) carbonate, poly(4,4cyclohexydine diphenylene) carbonate, and poly(4,4'-isopropyiidene-3,3'dimethyl-diphenyl) carbonate, and wherein said photoconductor has minimal wear characteristics of from about 25 to about 35 nanometers per kilocycle.

* * * * *